United States Patent [19]

Feuerman

[11] 4,158,551

[45] Jun. 19, 1979

[54] GASOLINE-WATER EMULSION

[76] Inventor: Arnold I. Feuerman, 5179 Corners Dr., West Bloomfield, Mich. 48033

[21] Appl. No.: 544,145

[22] Filed: Jan. 27, 1975

[51] Int. Cl.[2] ..... C10L 1/32

[52] U.S. Cl. ..... 44/51

[58] Field of Search ..... 44/51, 66

[56] References Cited

U.S. PATENT DOCUMENTS

| | | | |
|---|---|---|---|
| 2,920,948 | 1/1960 | Weeks | 44/51 |
| 3,037,056 | 5/1962 | Lowe et al. | 44/66 |
| 3,606,868 | 9/1971 | Voogd | 44/51 |

*Primary Examiner*—Winston A. Douglas
*Assistant Examiner*—Y. Harris-Smith
*Attorney, Agent, or Firm*—Krass & Young

[57] ABSTRACT

A gasoline-water emulsion suitable for use with conventional automobile engines designed to run on gasoline, with only minor modifications of their carburetion system, is formed by mixing gasoline, water and surfactants, including a nonionic ethoxylated alkyphenol, which combine these ingredients into an homogeneous mixture.

1 Claim, No Drawings

GASOLINE-WATER EMULSION

BACKGROUND OF THE INVENTION

1. Field of the Invention

This invention relates to a gasoline-water emulsion containing a minor amount of surfactants, suitable for use in a conventional vehicle engine.

2. Prior Art

The presence of limited quantities of water in the combustion chamber of an internal combustion engine is known to improve the engine operation in several respects. First, the water lowers the temperature of the combustion to minimize predetonation and thus effectively decreases the octane requirement of the fuel for a given engine compression ratio. The cooler burning also enhances the completeness of the combustion process, producing an emission with fewer pollutants. Finally, the water addition in the combustion process increases the fuel efficiency of the engine to substantially reduce the hydrocarbon fuel required for operation.

Water injection has long been used with jet engines to increase power during take-off and a variety of schemes have been proposed for the injection of water vapor directly into the combustion chambers of reciprocating and other engines and other fuel burners. Additionally, efforts have been made to form emulsions of water directly in hydrocarbon fuel so that the water may be introduced along with the fuel, in a controlled ratio, through the carburetion or fuel injection process. In addition to the other advantages obtained by the presence of water in the combustion chamber, gasoline-water emulsions are less volatile and accordingly safer to store and use than conventional gasolines.

Certain of the hydrocarbon-water emulsions previousy proposed contained relatively high percentages of water; i.e., 30 percent by volume or more, which may have been suitable for use in jet engines because of the high combustion temperatures involved, but were totally unsuitable for use with conventional automobile engines as the resulting emulsion did not have sufficient volatility to form explosive vapors at the lower combustion temperatures of an automobile engine and would effectively quench the explosion. Accordingly, one of the objects of the present invention is to provide a gasoline-water emulsion containing water in sufficient quantities to provide the desired improvement in the combustion process while still maintaining the volatility and explosiveness of the emulsion within a range which allows it to provide effective performance in a normal automobile engine.

Efforts have been made to obtain gasoline-water emulsions through the use of various surfactants and combinations of surfactants. Certain of the surfactants suggested must be employed in such large quantities as to themselves interfere with the combustion process, produce substantial polluting components in the exhaust, and raise the cost of the emulsion of an uneconomic level.

SUMMARY OF THE INVENTION

The present invention is directed toward a gasoline-water emulsion having a water and surfactant content which will allow it to be used with automobile and other engines as a replacement for conventional gasoline, with only minor modification of the engines carburetion system to achieve most of the advantages associated with water injection. When employed with carburetion systems designed specifically for the fuel, outstanding economies of operation may be attained.

The water-fuel emulsion of the present invention employs surfactants in such minimal quantities that the combustion products of the surfactants do not appreciably increase the polluting components of the emission from the engine.

Since the quantity of water that can be emulsified in gasoine is a function of both the type and quantity of emulsifiers used, the present invention depends upon an unique combination of emulsifiers used with a quantity of water falling within a critical range.

The present invention broadly comprises a gasoline-water emulsion containing not more than 22.5 percent by volume of water, and a surfactant including 1 percent to 3.5 percent by volume of a non-ionic ethoxylated alkylephenol surfactant having from 1½ to 30 moles of ethylene oxide for each mole of nonylphenol.

Surfactants of this type have a hydrophobic-hydrophilic balance and have previously been proposed for use in preparing jet fuel-water emulsions wherein water is the major component (see, for example, U.S. Pat. No. 2,920,948).

Fuel in accordance with the present invention may be formed using this primary surfactant alone but the invention more narrowly contemplates use of a secondary surfactant consisting of coconut diethanolamine super amide in quantities no greater than the alkyphenol.

Within the range 1½ to 30 moles of ethylene oxide per mole of nonylphenol, the nonylphenol has a sufficient hydrophobic-hydrophilic balance to form the desired emulsion. An equal quantity by volume of the diethanolamine, combined with nonylphenol, will enhance the completion of the emulsion.

Other additives may also be used with gasoline-water emulsions formed in accordance with the present invention. One of the advantages of the present emulsion is that it can be both clarified and deterred from separating from emulsion because of temperature changes, by the addition of a very small quantity of a polyoxyethylated dialkyl phenol; specifically, at least ⅓ of 1 percent by volume of this clarifier-depressant may be used with the emulsified fuel.

The gasoines employed with the present invention may be conventional hydrocarbon mixtures with an initial boiling range of between about 70° to 450° F. That includes all gasolines utilized in the United States at this time, including leaded and unleaded fuels.

The gasoline-water emulsion of the present invention can be readily formed by adding the surfactants to the gasoline and then introducing tap water. No prior stirring between the gasoline and surfactants is required, nor between those components and the tap water, since the normal movement of the vehicle will achieve what little stirring or agitation might be required to complete the emulsion.

The gasoline-water emulsions obtained from the present invention may be utilized in a conventional automobile or other engines or burners with only minor modifications to the engine's carburetion or fuel-injection system to accommodate the properties of the emulsion; for example, to accommodate differences in specific gravity, viscosity and combustibility as between conventional gasoline and the present emulsion.

Increases in fuel economy in excess of 25 percent have been observed using the present emulsions with a test engine.

Both the non-ionic ethoxylated alklyphenol surfactant and the diethanolamine surfactant, used to emulsify the gasoline-water combination, are readily available from a variety of commercial sources. These emulsifiers are not expensive and are used in such small quantities that they do not appreciably increase the cost of the resulting fuel.

Depending upon the percentage of water utilized, and the exact composition of the gasoline, it may be desirable to employ a mixture of two or more ethoxylated alkylphenols having different mole ratios.

EXAMPLE I 1 ml. of IGEPAL CO530 and 1 ml. of CALAMIDE C were poured into 78 ml. of gasoline and then 20 ml. of tap water was added. A slight shaking of the container formed a clear emulsion.

The IGEPAL is manufactured by GAF Corporation and is a non-ionic ethoxylated alkylphenol containing 6 moles of ethylene oxide per mole of nonylphenol. The CALAMIDE C is manufactured by Pilot Chemical Company and is a coconut oil diethanolamine super amide.

EXAMPLE II 1.5 ml. of IGEPAL CO210, a non-ionic ethoxylated alkylphenol having 1.5 moles of ethylene oxide per mole of nonylphenol was added to 82 ml. of gasoline in a beaker. 1.5 ml. of CALAMIDE C was added and 15 ml. of water. A gentle shaking of the beaker produced a clear emulsion of the gasoline in the water.

EXAMPLE III 3.5 ml. of VARONIC N30-7 and 3.5 ml. of VARAMIDE MA-1 were mixed with 70.5 ml. of gasoline and 22.5 ml. of water. The VARONIC N30-7 is produced by Ashland Chemical Company and contains 30 moles of ethylene oxide per mole of nonylphenol. The VARAMIDE MA-1 is also a product of Ashland Chemical Company and consists of a coconut oil diethanolamide super amide.

EXAMPLE IV 2 ml. of VARONIC N-6 was poured into a beaker containing 88 ml. of gasoline. 10 ml. of tap water were added and emulsified into the gasoline by gently shaking the beaker. The VARONIC N-6 is a product of Ashland Chemical Company and contains 6 moles of ethylene oxide per 1 mole of nonylphenol.

The embodiments of the invention in which an exclusive property or privilege is claimed are defined as follows:

1. A fuel suitable for use in internal combustion engines, comprising an emulsion of not more than 22.0 percent by volume of water in gasoline and including about 1 percent to 3.5 percent by volume of a non-ionic ethoxylated alkylphenol wherein the alkylphenol contains from 1½ to 30 moles of ethylene oxide per mole of nonylphenol and further including about one tenth of one percent by volume of a polyethenoxy derivative of a dialkylphenol.

* * * * *